US010182294B2

(12) United States Patent
Nozaki

(10) Patent No.: US 10,182,294 B2
(45) **Date of Patent: *Jan. 15, 2019**

(54) ELECTROACOUSTIC TRANSDUCER

(71) Applicant: Yamaha Corporation, Hamamatsu-shi, Shizuoka-ken (JP)

(72) Inventor: Akihiko Nozaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/471,103

(22) Filed: Mar. 28, 2017

(65) Prior Publication Data

US 2017/0201834 A1 Jul. 13, 2017

Related U.S. Application Data

(63) Continuation of application No. PCT/JP2015/074196, filed on Aug. 27, 2015.

(30) Foreign Application Priority Data

Sep. 29, 2014 (JP) ..... 2014-198789
Apr. 20, 2015 (JP) ..... 2015-086310

(51) Int. Cl.
*H04R 7/12* (2006.01)
*H04R 7/14* (2006.01)
(Continued)

(52) U.S. Cl.
CPC ..... *H04R 7/12* (2013.01); *H04R 7/14* (2013.01); *H04R 7/16* (2013.01); *H04R 9/04* (2013.01);
(Continued)

(58) Field of Classification Search
CPC ... H04R 7/12; H04R 7/14; H04R 7/16; H04R 7/24; H04R 9/045; H04R 9/06; H04R 2207/00; H04R 2207/021
See application file for complete search history.

(56) References Cited

U.S. PATENT DOCUMENTS 6,061,461 A * 5/2000 Paddock ..... H04R 9/06 381/186

FOREIGN PATENT DOCUMENTS

EP 1 182 907 A2 2/2002
JP 32-7807 9/1957
(Continued)

OTHER PUBLICATIONS

International Search Report (PCT/ISA/210) issued in PCT Application No. PCT/JP2015/074196 dated Oct. 13, 2015 with English translation (Four (4) pages).
(Continued)

*Primary Examiner* — Joshua Kaufman
(74) *Attorney, Agent, or Firm* — Crowell & Moring LLP

(57) ABSTRACT

An electroacoustic transducer is provided and includes: a diaphragm having a pair of longitudinal split tubular surfaces arranged next to each other, a valley being formed between respective side portions of the pair of longitudinal split tubular surfaces; a converter including a magnet mechanism and a voice coil configured to perform conversion between vibration of the diaphragm along a depth direction of the valley and an electric signal corresponding to the vibration; and a supporter that supports the diaphragm such that the diaphragm is vibratable along the depth direction of the valley. A tubular portion is provided at an intermediate portion of the valley to couple the diaphragm and the voice coil to each other, and the tubular portion extends in the depth direction of the valley.

8 Claims, 11 Drawing Sheets

(51) Int. Cl.

| | |
|---|---|
| ***H04R 9/04*** | (2006.01) |
| ***H04R 9/06*** | (2006.01) |
| ***H04R 7/16*** | (2006.01) |
| *H04R 7/24* | (2006.01) |

(52) U.S. Cl.
CPC ..... *H04R 9/045* (2013.01); *H04R 9/06* (2013.01); *H04R 7/24* (2013.01); *H04R 2207/021* (2013.01)

(56) References Cited

FOREIGN PATENT DOCUMENTS

| | | | | | |
|---|---|---|---|---|---|
| JP | 58-103297 | A | | 6/1983 | |
| JP | 60-16797 | A | | 1/1985 | |
| JP | 60171899 | A | * | 9/1985 | ..... H04R 7/14 |
| JP | 8-102988 | A | | 4/1996 | |
| JP | 10-191494 | A | | 7/1998 | |
| JP | 2002-78079 | A | | 3/2002 | |
| JP | 3521319 | B2 | | 4/2004 | |
| JP | 2008-124630 | A | | 5/2008 | |

OTHER PUBLICATIONS

Japanese-language Written Opinion (PCT/ISA/237) issued in PCT Application No. PCT/JP2015/074196 dated Oct. 13, 2015 with English translation (Twelve (12) pages).
Extended European Search Report issued in counterpart European Application No. 15847623.4 dated May 3, 2018 (six pages).

* cited by examiner

ELECTROACOUSTIC TRANSDUCER

CROSS REFERENCE TO RELATED APPLICATIONS

This application is a continuation of PCT International Application No. PCT/JP2015/074196, filed Aug. 27, 2015, which claims priority under 35 U.S.C. § 119 from Japanese Patent Application No. 2014-198789, filed Sep. 29, 2014, and Japanese Patent Application No. 2015-086310, filed Apr. 20, 2015, the entire disclosures of which are herein expressly incorporated by reference.

BACKGROUND

The present invention relates to an electroacoustic transducer for a speaker configured to reproduce sounds by vibrating longitudinal split tubular surfaces and to a microphone configured to pick up sounds.

In conventional cone-type speakers, an end portion of a voice coil as a driving device and an end portion of a cone-type membrane are joined to each other in their entire perimeter, enabling good transmission of vibration. However, in the case where sounds over a wide audible frequency range are reproduced by a single speaker unit, directivity is not uniform between a high frequency range and a low frequency range, resulting in narrow directivity over the high frequency range. To make the directivity uniform over all the audible frequency ranges, a speaker specific to the high frequency range is required.

As disclosed in Japanese Patent No. 3521319 for example, riffell speakers in contrast include a diaphragm having a pair of longitudinal split tubular membranes arranged side by side, and side portions of the respective longitudinal split tubular membranes are joined to each other, resulting in good directivity at the middle and high frequencies. In such a riffell speaker, however, since the coupled portion of the membranes extends straight, the coupled portion of the membranes and a circular voice coil are coupled to each other at only two positions, resulting in a weak construction. Thus, the coupled portions have low durability, and transmission of vibration is not reliable. Moreover, Japanese examined Patent Application Publication No. 32-7807, for example, discloses a speaker having V-shaped cuts in end portions of a voice coil. A bent portion of a wing-pair membrane is mounted in these cuts. In this speaker, mounting the membrane in the cuts formed in the voice coil increases the strength of the coupled portions when compared with the speaker disclosed in Japanese Patent No. 3521319. However, this increase is not sufficient, and further improvement is required.

SUMMARY OF THE INVENTION

The present invention relates to a diaphragm including a pair of longitudinal split tubular surfaces arranged side by side like a riffell speaker (e.g., an electroacoustic transducer). The object of the present invention is to increase the strength and durability of the diaphragm at its portion mounted on a voice coil (e.g., a converter) to improve transmission of vibration between the voice coil (e.g., the converter) and the diaphragm.

In accordance with one or more embodiments of the present invention, an electroacoustic transducer includes: a diaphragm having a pair of longitudinal split tubular surfaces arranged next to each other, a valley being formed between respective side portions of the pair of longitudinal split tubular surfaces; a converter including a magnet mechanism and a voice coil configured to perform conversion between vibration of the diaphragm along a depth direction of the valley and an electric signal corresponding to the vibration; and a supporter that supports the diaphragm such that the diaphragm is vibratable along the depth direction of the valley. A tubular portion is provided at an intermediate portion of the valley to couple the diaphragm and the voice coil to each other, and the tubular portion extends in the depth direction of the valley.

In the electroacoustic transducer, for example, the longitudinal split tubular surfaces serve as vibration surfaces. Thus, in the case where the present invention is applied to a speaker, the directivity of the speaker is wide at middle and high frequencies as in the riffell speaker. Also, in the case where the present invention is applied to a microphone, the microphone can pick up sounds with wide directivity.

Moreover, the electroacoustic transducer includes the tubular portion that couples the diaphragm and the voice coil to each other. Thus, the diaphragm and the voice coil can be firmly fixed to each other throughout the entire length thereof in their circumferential direction. With this construction, vibration is transmitted with a small loss, resulting in reliable transmission of vibration between the diaphragm and the converter and in improved durability.

The electric acoustic device according to one or more embodiments of the present invention may be constructed such that a through hole is formed through the diaphragm at a position at which the tubular portion is provided, and a cap member that closes the through hole is provided.

The cap member closes the through hole, preventing ingress of dust particles or the like into the voice coil. The cap member may have any of various shapes in accordance with required vibration characteristics. For example, the cap member may have a dome shape with a rising central portion or a conical trapezoid shape.

The electroacoustic transducer according to one or more embodiments of the present invention may be constructed such that the tubular portion is provided on a deep-side surface of the diaphragm in the depth direction of the valley, without a through hole formed through the diaphragm at a position at which the tubular portion is provided.

The ingress of dust particles or the like into the voice coil can also be prevented by closing the tubular portion with a back surface, e.g., a surface of the diaphragm in the depth direction of the valley, without a through hole formed through the diaphragm.

The electric acoustic device according to one or more embodiments of the present invention is preferably constructed such that the cap member includes a pair of longitudinal split tubular surfaces and a valley respectively connected to the pair of longitudinal split tubular surfaces and the valley of the diaphragm.

The surface of the cap member includes the pair of longitudinal split tubular surfaces and the valley like the longitudinal split tubular surfaces and the valley of the wing-pair portion. Thus, the entire surface including the surface of the cap member serves as the surfaces of the longitudinal split tubes, enabling the entire surface to reproduce (e.g., in the case of speaker) or pick up (e.g., in the case of microphone) sounds with wide directivity.

The longitudinal split tubular surfaces of the cap may be continuously flush with the respective longitudinal split tubular surfaces of the diaphragm and may be spaced apart from the respective longitudinal split tubular surfaces of the diaphragm.

The electroacoustic transducer according to one or more embodiments of the present invention may be constructed such that the tubular portion is coupled to the diaphragm such that a direction in which an axis of the tubular portion extends substantially coincides with a direction in which the diaphragm is vibrated.

The electroacoustic transducer according to one or more embodiments of the present invention may be constructed such that the valley extends in an extending direction intersecting the depth direction of the valley, and that the tubular portion is coupled to the diaphragm at a position between a central position of the valley in the extending direction and an end portion of the diaphragm.

The electroacoustic transducer according to one or more embodiments of the present invention may be constructed such that the tubular portion is coupled to the voice coil in a state in which an axis of the tubular portion coincides with an axis of the voice coil.

These inventions enable reliable transmission of vibration between the diaphragm and the voice coil (e.g., the converter).

The electroacoustic transducer according to the one or more embodiments of the present invention is advantageous in numerous ways, for example, it can reproduce and pick up sounds with wide directivity. Moreover, the diaphragm and the voice coil (e.g., the converter) can be firmly fixed to each other with high durability. Vibration can be transmitted with a small loss, resulting in reliable transmission of vibration between the diaphragm and the voice coil (e.g., converter).

DETAILED DESCRIPTION OF THE EMBODIMENTS OF THE INVENTION

Figure 1:
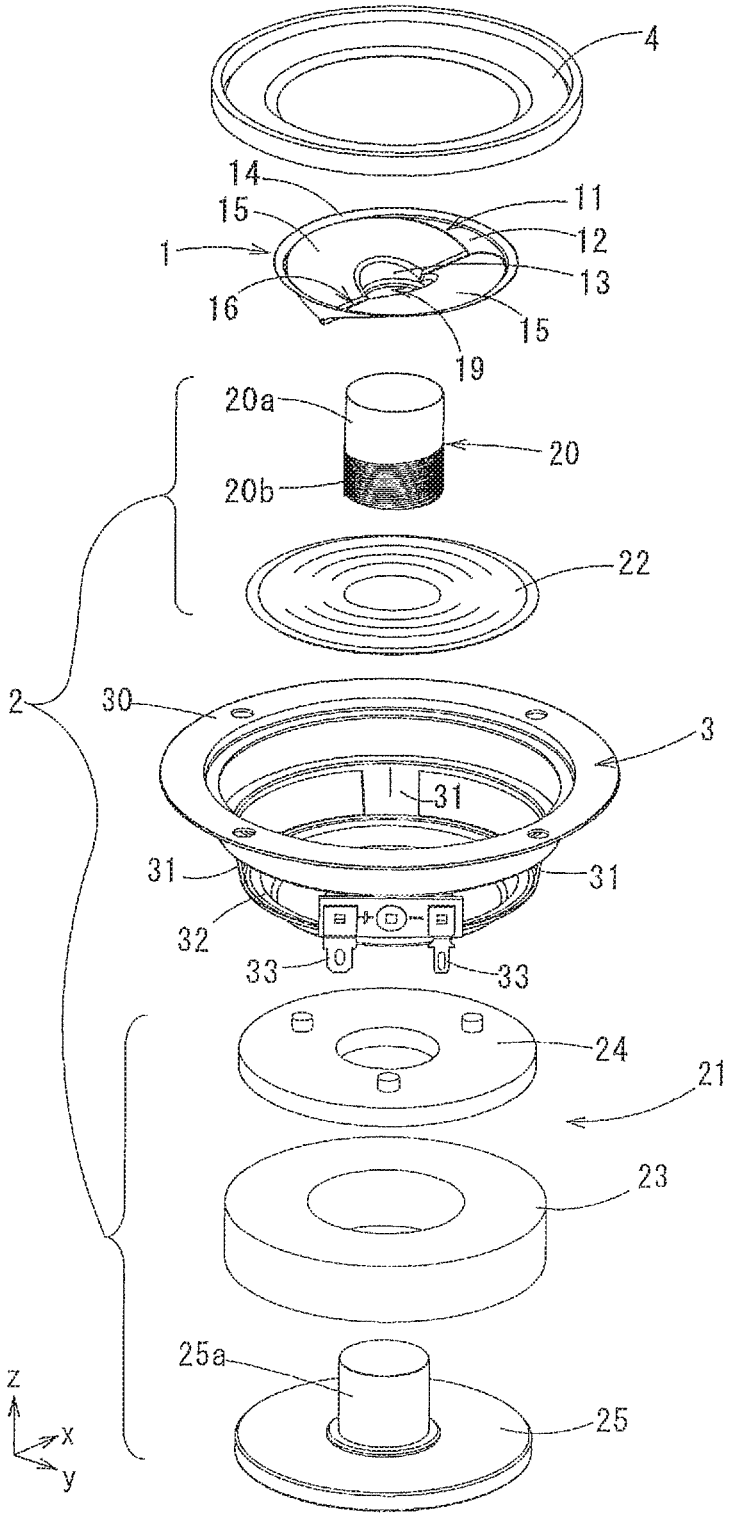
FIG. 1 illustrates an exploded perspective view of a speaker according to a first embodiment of the present invention.

FIGS. 1-7 illustrate a speaker (e.g., an electric acoustic device) 100 according to a first embodiment of the present invention.

1. Overall Construction

The speaker 100 according to this embodiment includes: a diaphragm 1; an actuator 2 (as one example of a converter in the present invention) for reciprocating the diaphragm 1; a support frame 3 for supporting the diaphragm 1 and the actuator 2; and an edge member 4 for supporting the diaphragm 1 such that the diaphragm 1 is reciprocable relative to the support frame 3.

Figure 2:
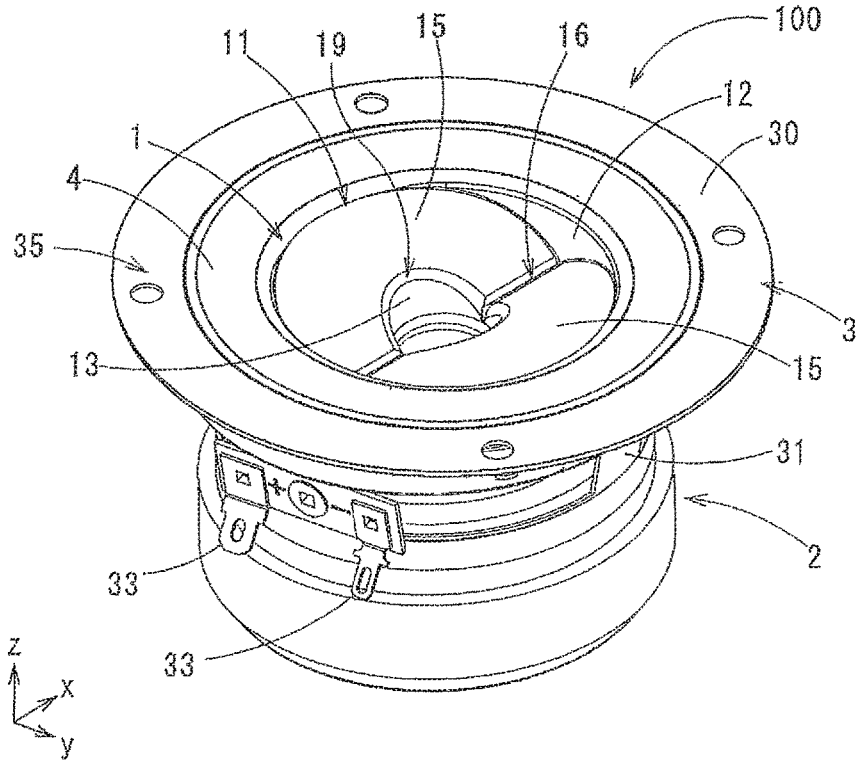
FIG. 2 illustrates a perspective view of the speaker in an assembled state.

In the state illustrated in FIGS. 1 and 2, the up and down direction is defined such that the upper side is a side on which the edge member 4 is provided, and the lower side is a side on which the actuator 2 is provided. The direction in which a valley of the diaphragm 1, which will be described below, extends is defined as the front and rear direction. The direction orthogonal to this direction is defined as the right and left direction. Surfaces facing upward may be referred to as front surfaces, and surfaces facing downward as back surfaces. As illustrated in the drawings, the front and rear direction, the right and left direction, and the up and down direction may be hereinafter referred to as "x direction", "y direction", and "z direction", respectively.

2. Constructions of Components (1) Construction of Diaphragm

As illustrated in the enlarged views in FIGS. 4-7, the diaphragm 1 includes: a wing-pair portion 11; an end plate 12 that closes opposite ends of the valley 16 (which will be described below) of the wing-pair portion 11; a tubular portion 13 secured to a back portion of the wing-pair portion 11; and a ring plate 14 for connection of the diaphragm 1 to the edge member 4. These components are formed integrally with each other.

The wing-pair portion 11 includes: a pair of longitudinal split tubular surfaces 15 arranged side by side; and the valley 16 defined between side portions of the respective longitudinal split tubular surfaces 15. Each of the longitudinal split tubular surfaces 15 is shaped by splitting and cutting a portion of a surface of a tube in its longitudinal direction (along its axial direction). The above-described side portions of the longitudinal split tubular surfaces 15 are side portions in a direction in which the tubular surfaces are curved.

Each of the longitudinal split tubular surfaces 15 may not be a single arc and may have a continuous series of curvatures. Also, the cross section of the longitudinal split tubular surface 15 along its circumferential direction (its widthwise direction) may have a curvature that changes constantly or continuously like a parabola and a spline curve. Also, the longitudinal split tubular surface 15 may be shaped like a surface of a polygonal tube or stepped so as to have a plurality of steps, for example. The longitudinal split tubular surface 15 is curved in one direction (the widthwise direction coinciding with the circumferential direction of the longitudinal split tubular surface 15). The longitudinal split tubular surface 15 extends straight in a direction orthogonal to the one direction (the longitudinal direction of the longitudinal split tubular surface 15).

Figure 5:
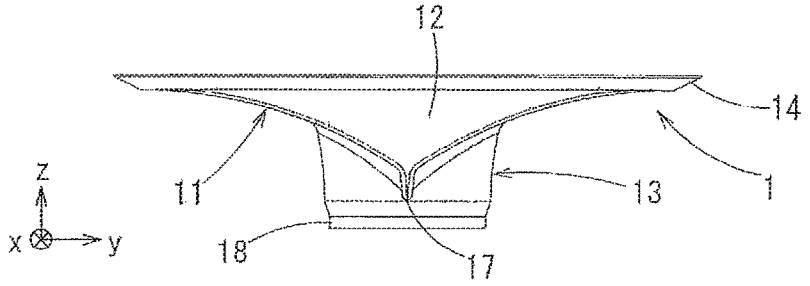
FIG. 5 illustrates a side view of the diaphragm viewed in the direction B in FIG. 4.
Figure 6:
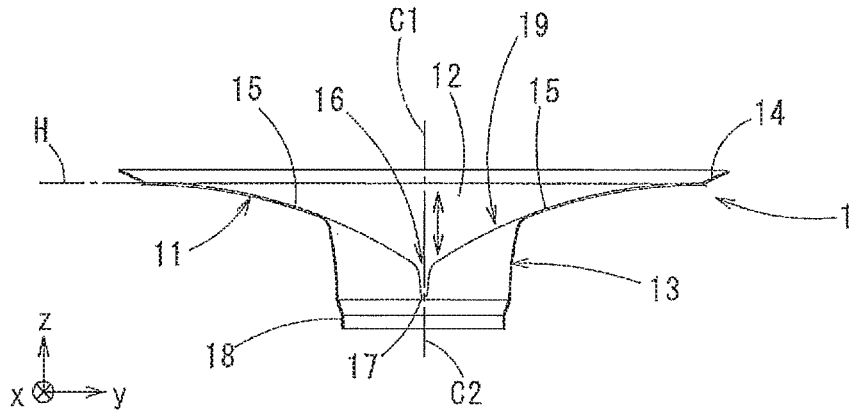
FIG. 6 illustrates a cross-sectional view taken along line A-A in FIG. 4.
Figure 7:
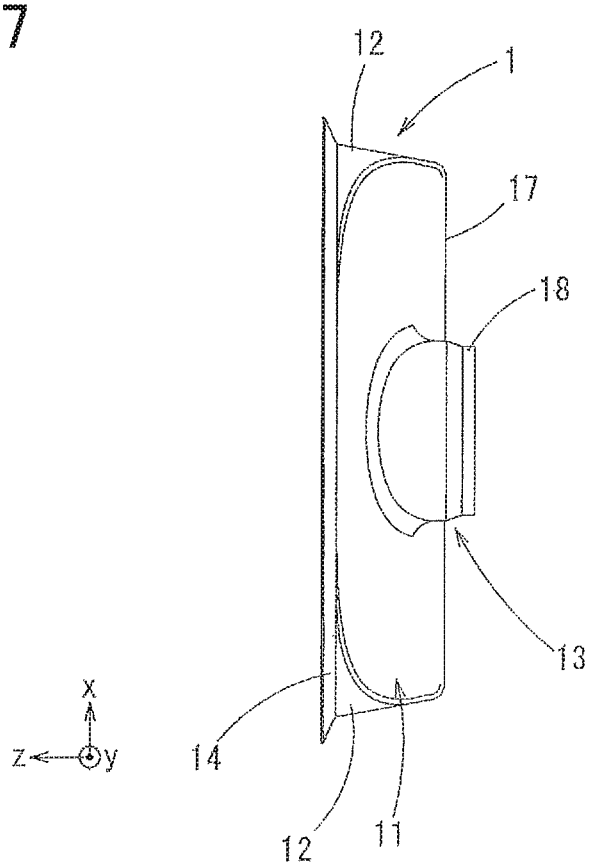
FIG. 7 illustrates a right side view of the diaphragm in FIG. 4.

As illustrated in FIGS. 5-7, the pair of longitudinal split tubular surfaces 15 are arranged side by side so as to each protrude in its front surface direction. The adjacent side portions are opposed to each other with a small space therebetween so as to have a U-shape in cross section along the circumferential direction of the longitudinal split tubular surface 15. Lower ends of the respective side portions are joined to each other so as to form a coupled portion 17 extending straight.

Figure 4:
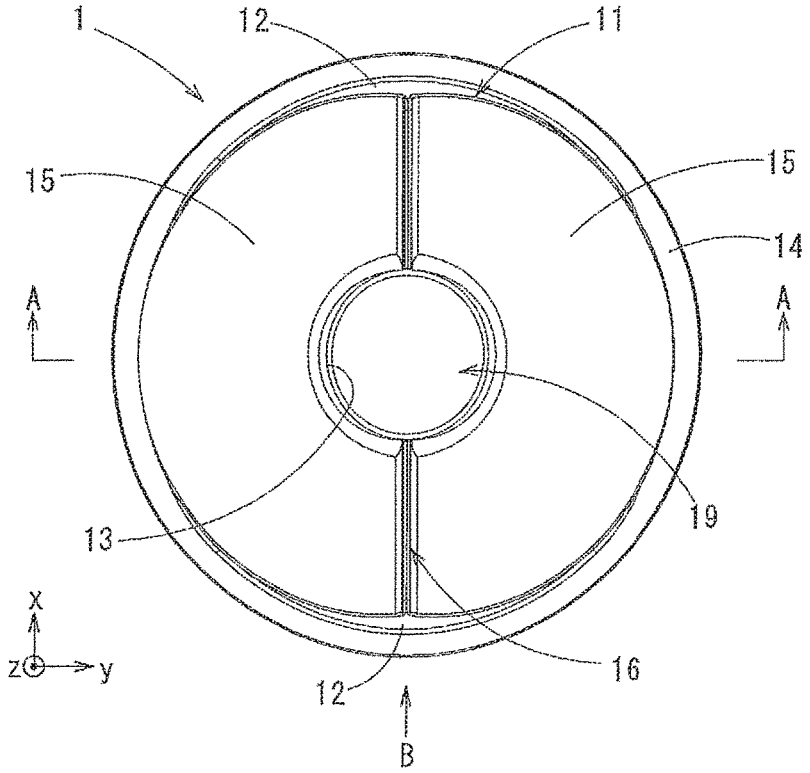
FIG. 4 illustrates an elevational view of a diaphragm of the speaker in FIG. 2.

As illustrated in FIG. 4, an outer circumferential edge of the wing-pair portion 11 is substantially shaped like a circle in elevational view, but this circular shape is not a perfect circle. Specifically, the outer circumferential edge of the wing-pair portion 11 is formed such that the distance between the opposite ends of the valley 16 is slightly shorter than the longest distance between two positions of the outer circumferential edge in a direction orthogonal to the valley 16 (the longest distance of the wing-pair portion 11 along the right and left direction of the sheet surface in FIG. 4). In other words, the distance in the direction orthogonal to the valley 16 is the longest on the outer circumferential edge of the wing-pair portion 11, and each of the opposite ends of the valley 16 is located on a slightly inner side of the circle, whose outside diameter is equal to the longest distance, in the radial direction of the circle in elevational view. The center of the circle of the wing-pair portion 11 in elevational view is defined as an axis C1 of the wing-pair portion 11 (see FIG. 6).

An outer circumferential edge of the end plate 12 is shaped like a circle whose longest diameter is equal to the distance between two positions on the outer circumferential edge of the end plate 12 in the direction orthogonal to the valley 16 of the wing-pair portion 11. Also, the end plate 12 extends from its outer circumferential edge to the opposite ends of the valley 16 of the wing-pair portion 11 in a circular-conical-surface shape to close the opposite ends of the valley 16. In other words, the end plate 12 shaped to partly constitute a circular conical surface is formed so as to close openings formed at the opposite ends of the valley 16 in order to define a circular outer-circumferential shape of the wing-pair portion 11 having the valley 16 formed by the side-by-side arrangement of the pair of longitudinal split tubular surfaces 15. The ring plate 14 is connected to outer surfaces of the wing-pair portion 11 and the end plate 12 around them along the outer circumferential edges of the wing-pair portion 11 and the end plate 12. The ring plate 14 has a circular-conical-surface shape.

The tubular portion 13 is provided in the middle of the valley 16 in a direction in which the valley 16 extends in elevational view, and a through hole 19 is formed in the wing-pair portion 11 in elevational view (see FIG. 4). The tubular portion 13 has a tubular shape extending in the depth direction of the valley 16 (see FIG. 3). The tubular portion 13 is joined to an upper end portion of a voice coil 20 so as to couple the wing-pair portion 11 and the voice coil 20 to each other (see FIG. 3). The tubular portion 13 is disposed in a state in which an axis C2 (see FIG. 6) extending through the center of the tubular portion coincides with the axis C1 of the wing-pair portion 11. The tubular portion 13 has a tapered tubular shape whose diameter gradually decreases from an upper end to a lower end of the tubular portion 13. The tubular portion 13 extends to a position below a lower end of the coupled portion 17 of the wing-pair portion 11. A straight tubular portion 18 having the constant diameter is integrally formed at a lower end portion of the tubular portion 13.

A bobbin 20*a* of the voice coil 20, which will be described below, is joined to the straight tubular portion 18 with, e.g., adhesive. As a result, the tubular portion 13 is fixed to the voice coil 20 in a state in which the axis C2 of the tubular portion 13 coincides with the axis of the voice coil 20.

It is noted that the diaphragm 1 may be formed of any material such as synthetic resin, paper, and metal which are typically used for membranes of speakers. For example, the diaphragm 1 can be integrally formed relatively easily by vacuum forming of a film formed of synthetic resin such as polypropylene and polyester.

It is noted that, as will be described below, the diaphragm 1 is vibrated in the z direction coinciding with the depth direction of the valley 16, and the tubular portion 13 is fixed to the diaphragm 1 (a back surface of the wing-pair portion 11) in a state in which a direction of the axis of the tubular portion 13 substantially coincides with the direction of the vibration of the diaphragm 1.

Regarding the positional relationship between the tubular portion 13 and the diaphragm 1, in other words, as illustrated in FIG. 4, the tubular portion 13 is connected to the diaphragm 1 (the wing-pair portion 11) between a central position of the valley 16 and an end portion of the wing-pair portion 11 in the direction in which the valley 16 extends (the x direction coinciding with the front and rear direction). That is, in the present embodiment, as illustrated in FIGS. 4-6, since the axis C2 of the tubular portion 13 extends through a central position of the coupled portion 17 of the valley 16 in the direction in which the valley 16 extends, the tubular portion 13 is connected to the wing-pair portion 11 (the coupled portion 17) between the central position and the end portion of the wing-pair portion 11 (around a central position of the wing-pair portion 11).

Considering that the outside diameter shape of the wing-pair portion 11 in elevational view is substantially the circular shape as in the present embodiment, the axis C2 of the tubular portion 13 extends through the center of the outside diameter shape of the wing-pair portion 11.

(2) Constructions of Components Other than Diaphragm

A voice coil motor is used for the actuator 2, for example. The actuator 2 includes: the voice coil 20 bonded to the tubular portion 13 provided at the back portion of the diaphragm 1; and a magnet mechanism 21 fixed to the support frame 3.

Figure 3:
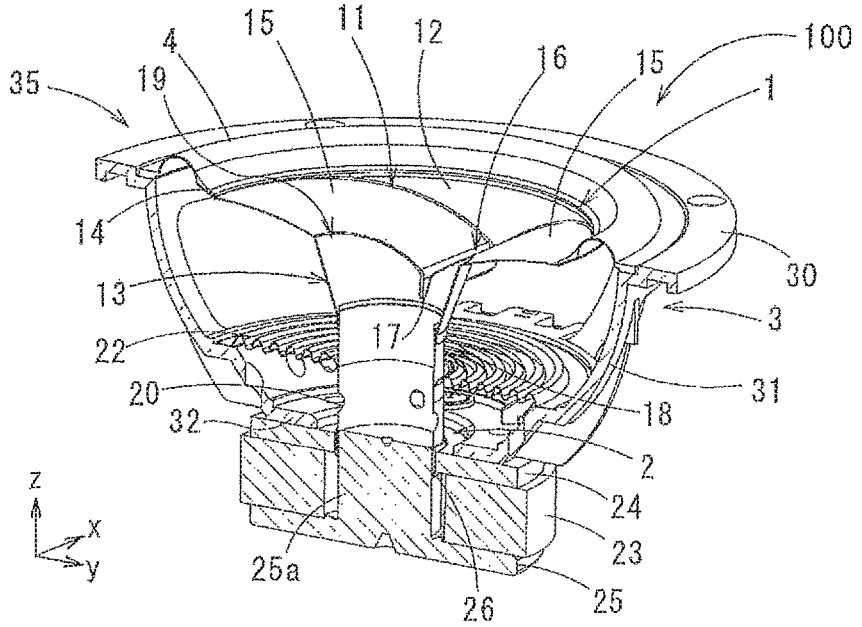
FIG. 3 illustrates a half cross-sectional perspective view of the speaker in FIG. 1 in the assembled state.

As illustrated in FIG. 1, the voice coil 20 includes the bobbin 20*a* having a cylindrical shape and a coil 20*b* wound around the bobbin 20*a*. As illustrated in FIG. 3, an upper end portion of the voice coil 20 is fitted in and fixed to the straight tubular portion 18 of the tubular portion 13 provided on the back portion of the wing-pair portion 11.

An outer circumferential portion of the voice coil 20 is supported by the support frame 3, with a damper 22 disposed therebetween. The voice coil 20 is reciprocable with respect to the support frame 3 in the axial direction of the voice coil 20. The damper 22 may be formed of a material which is used for the typical dynamic speaker.

The magnet mechanism 21 includes an annular magnet 23, a ring-shaped outer yoke 24 secured to one of opposite poles of the magnet 23, and an inner yoke 25 secured to the other of the opposite poles of the magnet 23. A distal end portion of a pole 25*a* standing on a center of the inner yoke 25 is disposed in the outer yoke 24, whereby an annular magnetic gap 26 is formed between the outer yoke 24 and the inner yoke 25, and an end portion of the voice coil 20 (a portion thereof at which the coil 20*b* is wound) is disposed in the magnetic gap 26.

The support frame 3 is formed of metal, for example. In the illustrated example, the support frame 3 includes: a flange portion 30 shaped like a circular frame; a plurality of arm portions 31 extending downward from the flange portion 30; and an annular frame portion 32 formed on lower ends of the respective arm portions 31. The diaphragm 1 is disposed in a space formed inside the flange portion 30, with the coupled portion 17 points downward. The ring plate 14 of the diaphragm 1 is bonded to an inner circumferential portion of the edge member 4. The diaphragm 1 is supported by the upper surface of the flange portion 30 via the edge member 4. Thus, the edge member 4 has a round ring shape corresponding to the ring plate 14 of the diaphragm 1. This edge member 4 can be formed of a material which is used for the typical dynamic speaker.

In the present invention, a supporter 35 that supports the diaphragm 1 so as to permit the vibration of the diaphragm 1 in the direction of the vibration (the z direction coinciding with the depth direction of the valley 16) is constituted by the support frame 3 and the edge member 4 in this embodiment.

Also, the outer yoke 24 of the magnet mechanism 21 is mounted on the annular frame portion 32 of the support frame 3, whereby the magnet mechanism 21 and the support frame 3 are integrally secured to each other.

In a state in which the diaphragm 1 is mounted on the support frame 3, as illustrated in FIG. 6, in the case where a boundary line H (see the one-dot chain line in FIG. 6) is a line connecting between outermost ends of the respective longitudinal split tubular surfaces 15 (at positions at which the distance from the valley 16 is the longest) in their respective curving directions, each of the longitudinal split tubular surfaces 15 is curved in such a direction that a distance between the longitudinal split tubular surface 15 and the boundary line H increases with increase in distance from the distal end of the longitudinal split tubular surface 15 toward the valley 16, in cross section along the circumferential directions (the right and left direction) of the respective longitudinal split tubular surfaces 15 opposed to each other, with the valley 16 interposed therebetween.

As described above, the longitudinal split tubular surface 15 is not limited to a single arc surface and may be a surface having a continuous series of curvatures, a surface whose cross section has a curvature which changes continuously or constantly like a parabola and a spline curve, a surface shaped like a surface of a polygonal tube, and a surface having a plurality of step portions, but the longitudinal split tubular surfaces 15 are preferably shaped so as not to project from the boundary line H connecting between the distal ends of the respective longitudinal split tubular surfaces 15.

It is noted that the reference numeral 33 in FIGS. 1 and 2 denotes a terminal for connecting the voice coil 20 to external devices.

3. Operations

In the speaker 100 constructed as described above, when a drive current based on a voice signal is supplied to the voice coil 20 of the actuator 2 secured to the diaphragm 1, a driving force generated based on the drive current is applied to the voice coil 20 by a change in magnetic flux generated by the drive current and a magnetic field in the magnetic gap 26, and the voice coil 20 is vibrated in a direction orthogonal to the magnetic field (e.g., the axial direction of the voice coil 20 and the z direction coinciding with the up and down direction indicated by the arrow in FIG. 6). This vibration causes the diaphragm 1 connected to the voice coil 20 to be vibrated along the axial direction of the valley 16 to radiate reproduced sounds from the front surface of the diaphragm 1.

In the diaphragm 1, the wing-pair portion 11 forms the most area of the diaphragm 1, and the end plate 12 is provided on a limited narrow area near the opposite ends of the valley 16. With this construction, sounds radiated from the longitudinal split tubular surfaces 15 of the wing-pair portion 11 which constitutes the most portion of the diaphragm 1 are dominant as sounds radiated from the speaker.

Accordingly, this diaphragm 1 has a wide directivity over middle and high frequencies like membranes used for riffell speakers.

Moreover, the diaphragm 1 is supported on the support frame 3 via the edge member 4 so as to permit reciprocating vibration of an outer circumferential portion of the diaphragm 1 in the depth direction of the valley 16. Thus, the entire diaphragm 1 from the coupled portion 17 to the outer circumferential portion is uniformly vibrated by the actuator 2, in other words, the diaphragm 1 is vibrated by what is called piston motion. Accordingly, the diaphragm provides a high sound pressure also at low frequencies like conventional dynamic speakers. If the opposite ends of the valley 16 are open, a sound wave radiated from the diaphragm partly passes through the openings toward the back side of the diaphragm. In this embodiment, however, the opposite ends of the valley 16 are closed by the end plate 12, preventing the sound wave from going toward the back side of the diaphragm 1, whereby the diaphragm 1 can efficiently emit sounds from the entire front surface of the diaphragm 1.

This construction enables a single speaker unit to function as a full-range speaker unit capable of reproducing sounds having wide directivity over the full range of audible frequencies including the low frequencies and the middle and high frequencies.

The directivity of sounds reproduced by the longitudinal split tubular surfaces 15 of the diaphragm 1 is wide in a direction along the circumferential direction of each longitudinal split tubular surface 15 and narrow in a direction orthogonal to the direction along the circumferential direction. Thus, a plurality of the speakers may be arranged in the front and rear direction such that the valleys 16 of the diaphragms 1 are continuous to each other, whereby a line array speaker system is provided, enabling achievement of an ideal sound space by a line sound source.

In the speaker 100 constructed as described above, the tubular portion 13 is provided on the back portion of the diaphragm 1, and this tubular portion 13 has the tubular shape so as to permit the upper end portion of the voice coil 20 of the actuator 2 to be fitted in and joined to the lower end portion of the tubular portion 13. Thus, even though the diaphragm 1 includes the wing-pair portion 11 having the longitudinal split tubular surfaces 15 joined to each other at the coupled portion 17 extending straight, like common dynamic speakers, it is possible to join the diaphragm 1 to the voice coil 20 having the cylindrical shape throughout the entire length of the voice coil 20 in its circumferential direction. Accordingly, the diaphragm 1 and the voice coil 20 are firmly connected to each other with large area and high durability, resulting in smaller loss of transmission of vibration between the diaphragm 1 and the voice coil 20, enabling reliable transmission of vibration between the diaphragm 1 and the voice coil 20.

Moreover, the same component as used in the common dynamic speakers may be used as the actuator 2 in the speaker according to the present embodiment, resulting in lower manufacturing cost.

Figure 8:
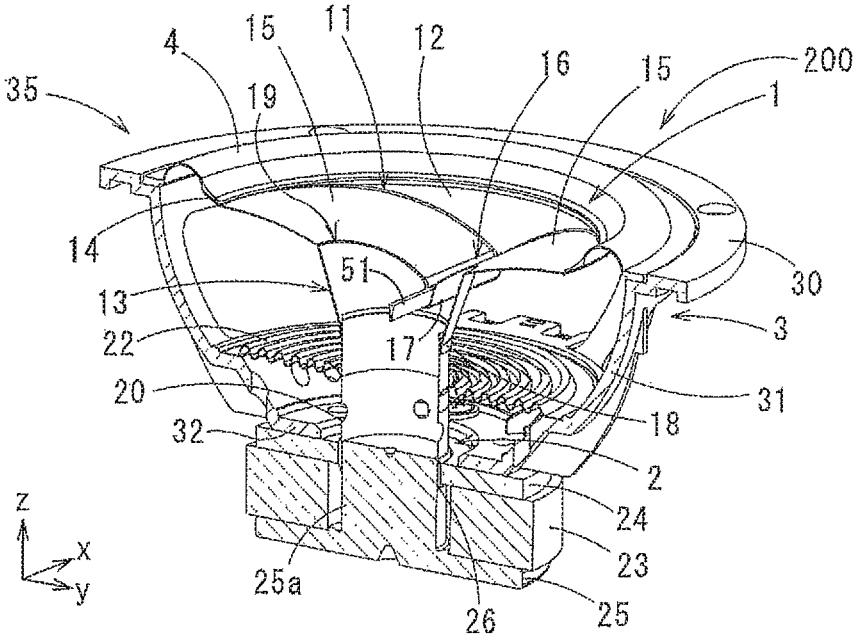
FIG. 8 illustrates a half cross-sectional perspective view of a speaker according to a second embodiment of the present invention.

FIG. 8 illustrates a speaker (an electroacoustic transducer) 200 according to a second embodiment of the present invention. It is noted that the same reference numerals as used in the first embodiment are used to designate the corresponding elements in this drawing, and an explanation of which is simplified (this applies to third and subsequent embodiments).

The speaker 200 according to the second embodiment illustrated in FIG. 8 is the same as the speaker according to the first embodiment in that the wing-pair portion 11, the end plate 12, the tubular portion 13, and the ring plate 14 of the diaphragm 1 are formed integrally with each other. In the speaker 200, however, a rigid bar 51 extending throughout the length of the valley 16 in its longitudinal direction is inserted and bonded to the U-shape portion of the coupled portion 17 of the wing-pair portion 11 in cross section. This strip-shaped bar 51 is inserted such that its widthwise direction coincides with the depth direction of the valley 16 of the wing-pair portion 11 (the z direction). The bar 51 at least extends throughout the tubular portion 13 in the longitudinal direction of the valley 16 (the x direction). The bar 51 has a small thickness to prevent increase in distance between the longitudinal split tubular surfaces 15 (the width of the valley 16) due to the insertion of the bar 51 in the valley 16. The width of the bar 51 (the dimension of the bar 51 in the z direction) is a minimum dimension required to achieve stiffness necessary for the coupled portion 17 of the wing-pair portion 11. The fixation of the bar 51 reinforces the coupled portion 17 of the wing-pair portion 11, resulting in more reliable transmission of vibration between the actuator 2 and the diaphragm 1, thereby enabling production of more stable frequency response.

It is noted that the strip-shaped bar 51 is preferably constituted by a single bar extending over the tubular portion 13 and throughout the entire length of the valley 16.

Figure 9:
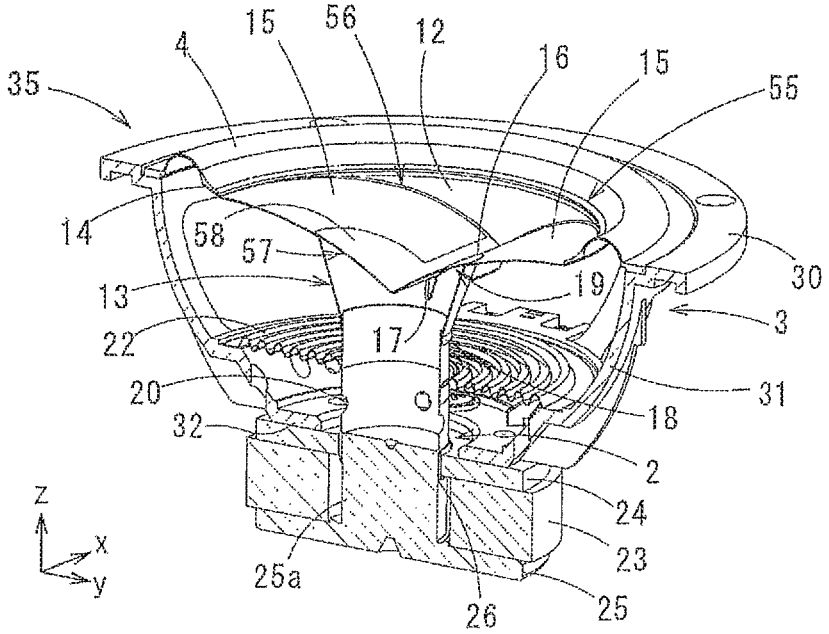
FIG. 9 illustrates a half cross-sectional perspective view of a speaker according to a third embodiment of the present invention.
Figure 10:
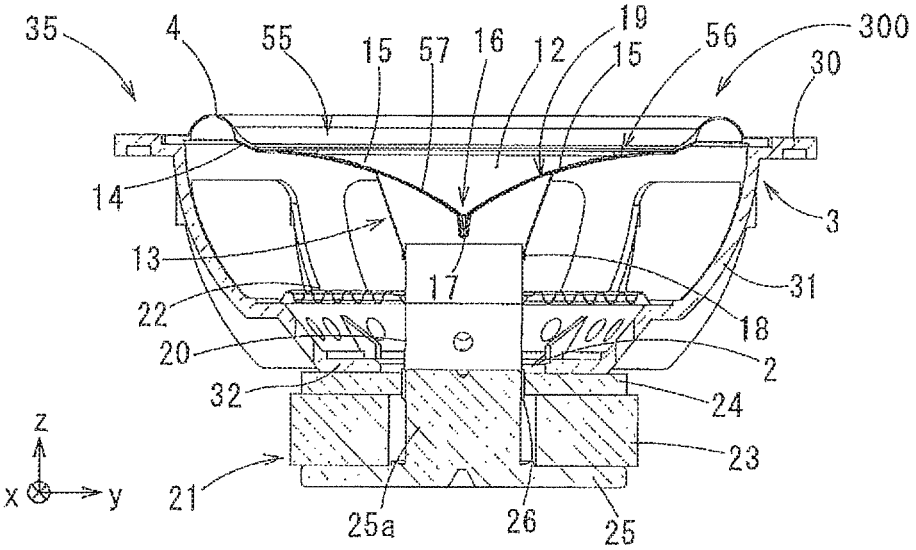
FIG. 10 illustrates an elevational view in vertical cross section of the speaker in FIG. 9.

FIGS. 9 and 10 illustrate a speaker (an electroacoustic transducer) 300 according to the third embodiment of the present invention.

In the diaphragm in the first embodiment and the second embodiment, an upper side of the valley 16 of the wing-pair portion and the tubular portion 13 is open, and a recessed space is formed over the valley 16 and the tubular portion 13. In a diaphragm 55 in the third embodiment, a closing plate (as one example of a cap member in the present invention) 57 is provided so as to close the through hole 19 formed in a wing-pair portion 56, that is, the closing plate 57 is provided so as to close a bottom portion of the valley 16 of the wing-pair portion 56 (the U-shaped portion in cross section) and an upper end of the tubular portion 13. A surface of this closing plate 57 has a valley-folded shape such that the longitudinal split tubular surfaces 15 of the wing-pair portion 56 are extended. The closing plate 57 has a pair of longitudinal split tubular surfaces 58 curved so as to be flush with the respective longitudinal split tubular surfaces 15. That is, each of the longitudinal split tubular surfaces 15 of the wing-pair portion 56 and a corresponding one of the longitudinal split tubular surfaces 58 of the closing plate 57 are the same in the circumferential direction (the curving direction) and continuous to each other. A U-shaped bottom portion of the wing-pair portion 56 in cross section is closed, and the valley 16 is defined by this portion and an upper surface of the closing plate 57 having the valley-folded shape.

With this construction, substantially the entire surface of the diaphragm 55 which includes the bottom portion of the valley 16 and a portion in which the tubular portion 13 is formed in the first and second embodiments includes longitudinal split tubular surfaces (the longitudinal split tubular surfaces 15 of the wing-pair portion 56 and the longitudinal split tubular surfaces 58 of the closing plate 57) and the valley 16. Thus, the diaphragm 55 is capable of reproducing and picking up sounds with its entire surface. Moreover, the inner space of the tubular portion 13 and the bottom portion of the valley 16 are closed by the closing plate 57, thereby preventing attachment of dust or the like in the inner space and the bottom portion.

Figure 11:
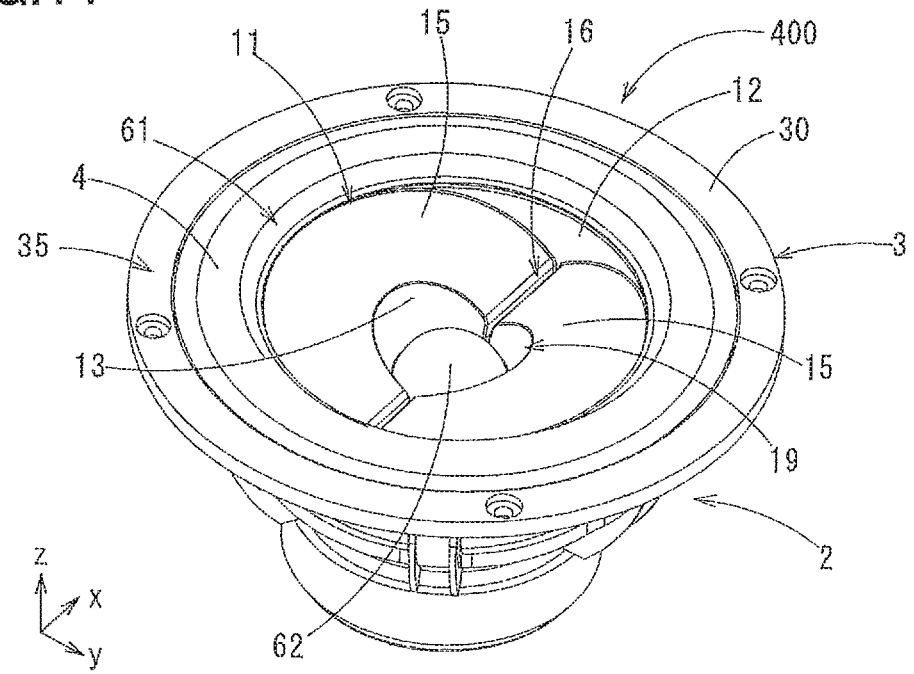
FIG. 11 illustrates a perspective view of a speaker according to a fourth embodiment of the present invention.
Figure 12:
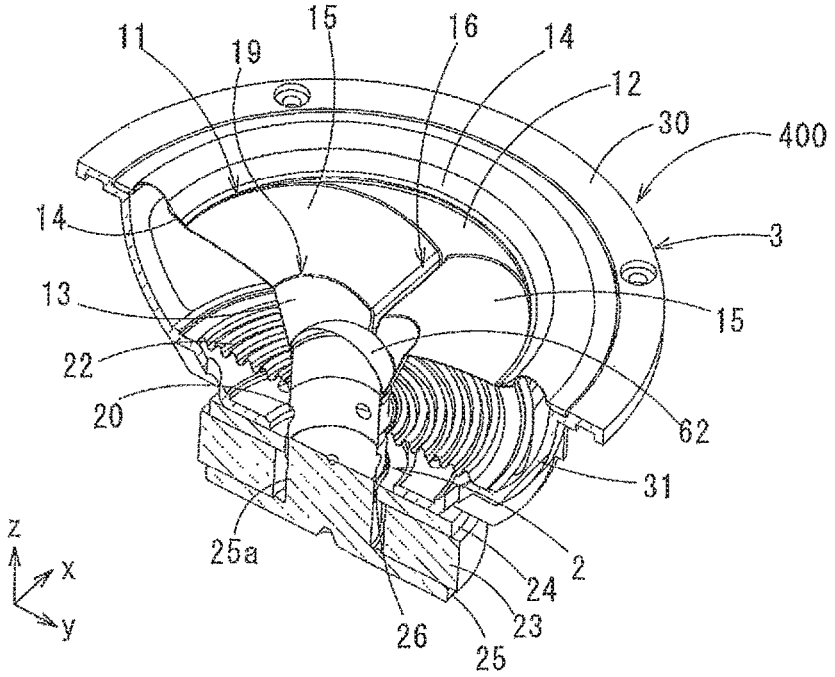
FIG. 12 illustrates a half cross-sectional perspective view of the speaker in FIG. 11.

FIGS. 11 and 12 illustrate a speaker (an electroacoustic transducer) 400 according to the fourth embodiment of the present invention.

In a diaphragm 61 in the fourth embodiment, the through hole 19 is formed at an area at which the tubular portion 13 is provided. A center cap (as another example of the cap member in the present invention) 62 which is provided for the common dynamic speakers is secured in the tubular portion 13 to close the inner space of the tubular portion 13. This center cap 62 is shaped like a half of a spherical shell and provided in the tubular portion 13 so as to protrude upward. A lower end portion of the center cap 62 is disposed under the coupled portion 17 so as not to form a space between the center cap 62 and the valley 16.

Figure 13:
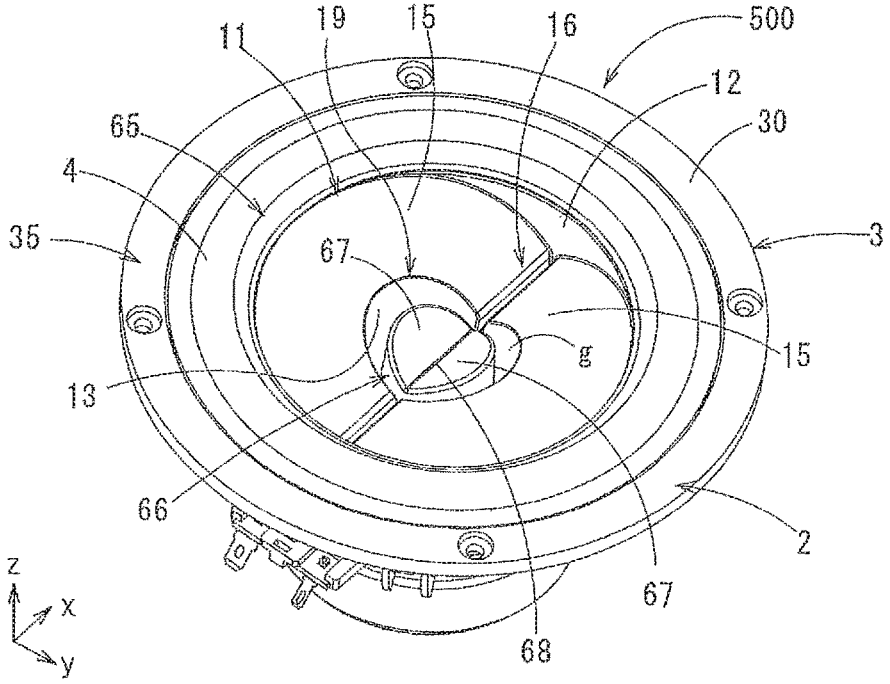
FIG. 13 illustrates a perspective view of a speaker according to a fifth embodiment of the present invention.
Figure 14:
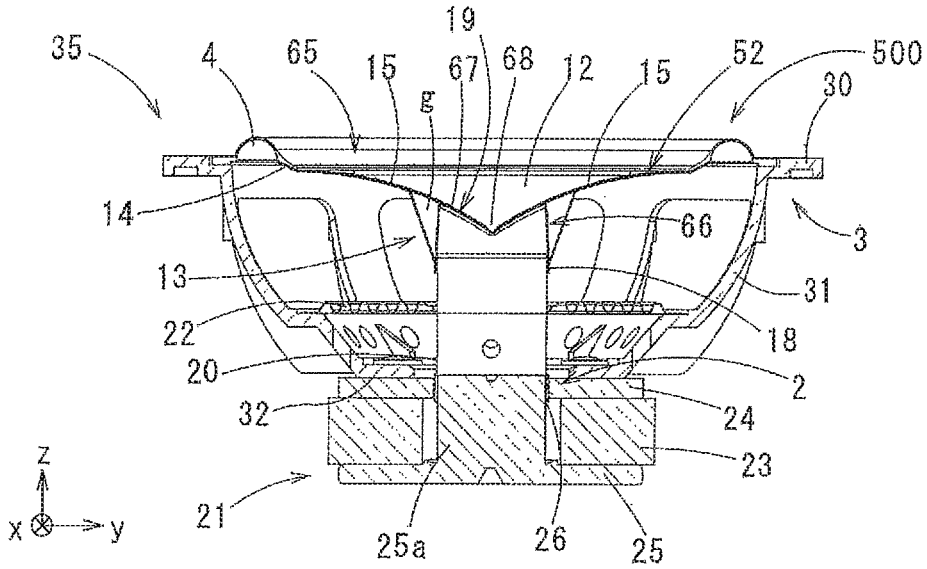
FIG. 14 illustrates an elevational view in vertical cross section of the speaker in FIG. 13.

FIGS. 13 and 14 illustrate a speaker (an electroacoustic transducer) 500 according to the fifth embodiment of the present invention.

In a diaphragm 65 in the fifth embodiment, as in the fourth embodiment, a center cap (as still another example of the cap member in the present invention) 66 that closes the inner space of the tubular portion 13 is provided in the tubular portion 13. An upper end surface of the center cap 66 has a valley-folded shape extending along the longitudinal split tubular surfaces 15 of the wing-pair portion 11. Thus, the upper end surface of the center cap 66 includes: a pair of longitudinal split tubular surfaces 67 each extending along the circumferential direction (the curving direction) of a corresponding one of the longitudinal split tubular surfaces 15; and a second valley 16 parallel with the valley 16. The longitudinal split tubular surfaces 15, 67 are continuous to each other, and the valleys 16, 68 are continuous to each other. The longitudinal split tubular surfaces 15, 67 may not have the same curvature, but the circumferential directions (the curving directions) of the longitudinal split tubular surfaces 15, 67 are the same as each other when these surfaces are viewed from above.

In the third embodiment, the closing plate 57 for covering the tubular portion 13 has the shape of the longitudinal split tubular surfaces 15. In this fifth embodiment, in contrast, the upper end surface of the center cap 66 provided in the tubular portion 13 has the shape along the longitudinal split tubular surfaces 15, whereby an annular space g is formed between an upper end of the center cap 66 and the upper end of the tubular portion 13. With this construction, the longitudinal split tubular surfaces 67 of the center cap 66 and the longitudinal split tubular surfaces 15 of the wing-pair portion 11 are continuous to each other, with the space g interposed therebetween, resulting in increase in the area of the longitudinal split tubular surfaces as the diaphragm. Since the inner space of the tubular portion 13 is closed by the center cap 66, ingress of dust or the like into the voice coil 20 is prevented even in the construction in which the space g is formed. It is noted that a lower end portion of the center cap 66 is located below the coupled portion 17 so as not to form a space between the center cap 66 and the valley 16.

Figure 15:
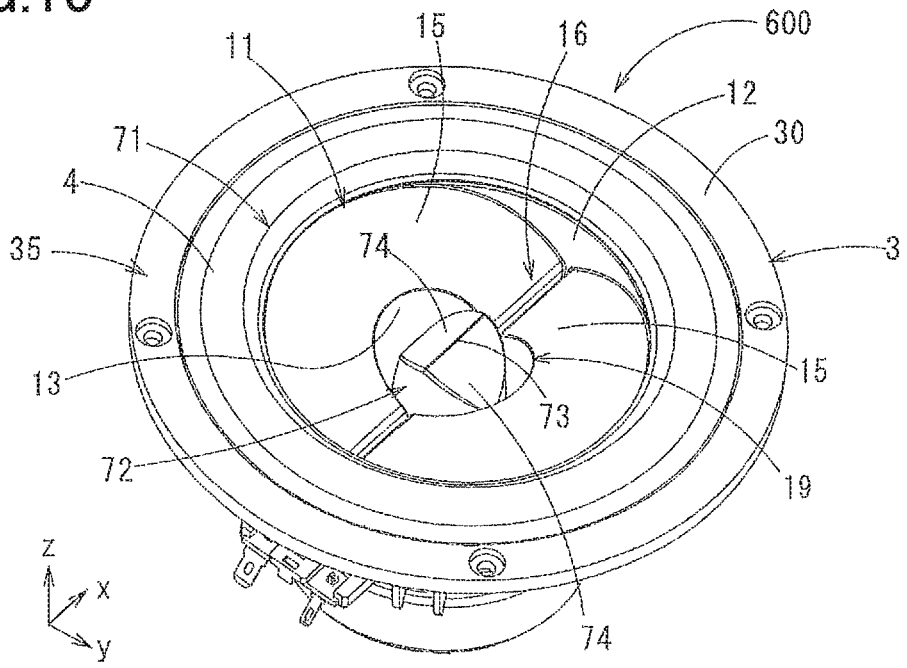
FIG. 15 illustrates a perspective view of a speaker according to a sixth embodiment of the present invention.
Figure 16:
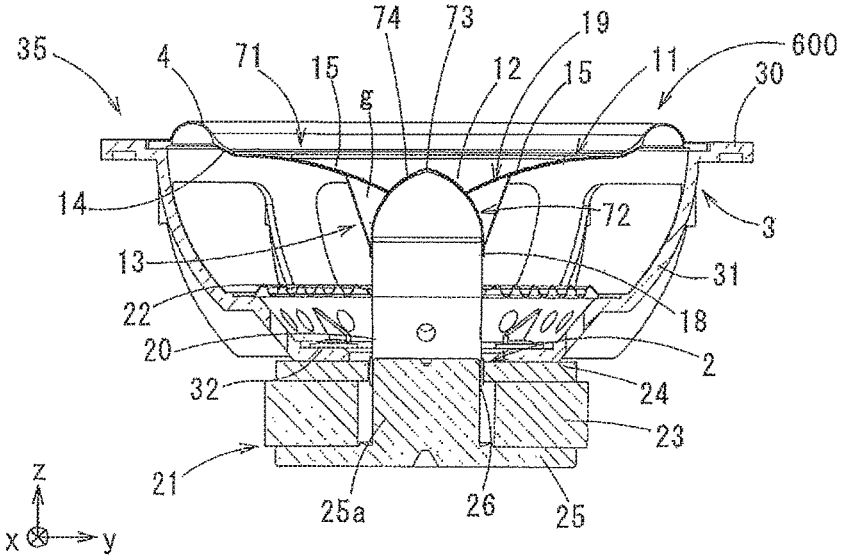
FIG. 16 illustrates an elevational view in vertical cross section of the speaker in FIG. 15.

FIGS. 15 and 16 illustrate a speaker (an electroacoustic transducer) 600 according to the sixth embodiment of the present invention.

In the fifth embodiment, the central portion of the diaphragm 65 is recessed because the upper end surface of the center cap 66 provided in the tubular portion 13 has the shape along the longitudinal split tubular surfaces. In a diaphragm 71 in the sixth embodiment, in contrast, a center cap (as still another example of the cap member in the present invention) 72 has a mountain shape having a protruding central portion, and this center cap 72 closes the inner space of the tubular portion 13. A top portion 73 of the mountain shape extends straight in the direction in which the valley 16 of the wing-pair portion 11 extends. Longitudinal split tubular surfaces 74 are respectively provided on opposite sides of the top portion 73. On each side, the longitudinal split tubular surface 74 is inclined at an angle reverse to that of the longitudinal split tubular surface 15 of the wing-pair portion 11. The circumferential direction (the curving direction) of each of the longitudinal split tubular surfaces 15 of the wing-pair portion 11 and that of a corresponding one of the longitudinal split tubular surfaces 74 of the center cap 72 are the same as each other when these surfaces are viewed from above.

The diaphragm 71 of the sixth embodiment also has the increased area of the longitudinal split tubular surfaces as the diaphragm.

It is noted that a lower end portion of the center cap 72 is disposed below the coupled portion 17 so as not to form a space between the center cap 72 and the valley 16.

Figure 17:
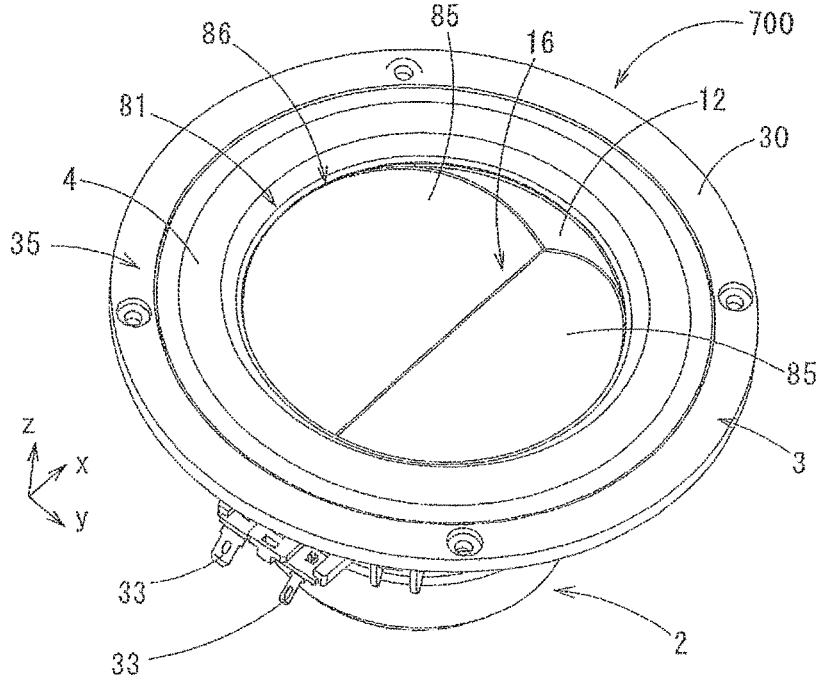
FIG. 17 illustrates a perspective view of a speaker according to a seventh embodiment of the present invention.
Figure 18:
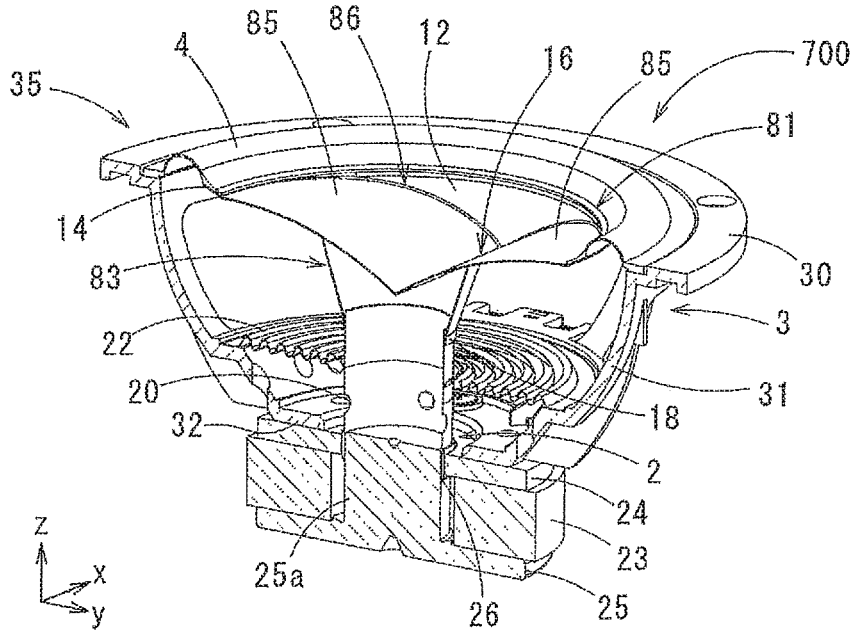
FIG. 18 illustrates a half cross-sectional perspective view of the speaker in FIG. 17.
Figure 19:
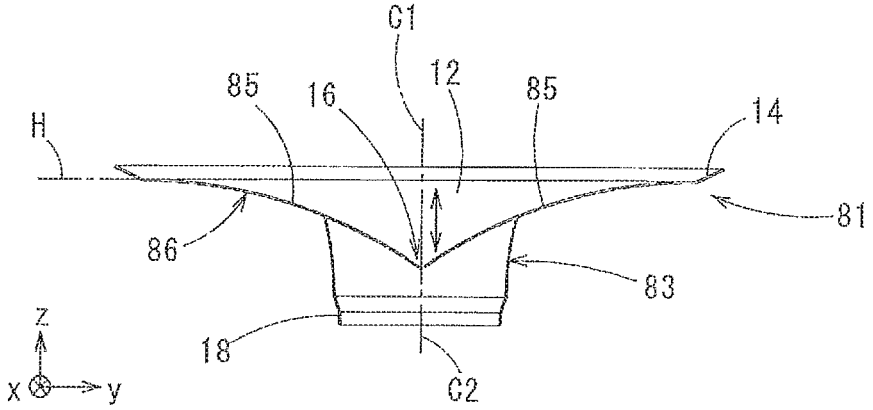
FIG. 19 illustrates an elevational view in vertical cross section illustrating a diaphragm of the speaker in FIG. 17.

FIGS. 17-19 illustrate a speaker (an electroacoustic transducer) 700 according to the seventh embodiment of the present invention.

In the third embodiment illustrated in FIGS. 9 and 10, the through hole 19 is formed in the portion of the diaphragm 55 at which the tubular portion 13 of the wing-pair portion 56 is provided, and this through hole 19 is closed by the closing plate 57. In a diaphragm 81 in the seventh embodiment, as illustrated in FIGS. 17-19, a wing-pair portion 86 has no through hole at a position at which a tubular portion 83 is provided. In this diaphragm 81, a pair of longitudinal split tubular surfaces 85 are arranged next to each other. The valley 16 is formed between side portions of the respective longitudinal split tubular surfaces 85 so as to extend continuously without separation. The tubular portion 83 is provided on a back surface (a lower surface) of the wing-pair portion 86, e.g., on a surface of the wing-pair portion 86 which is nearer to the bottom of the valley 16 in the depth direction. An upper end of the tubular portion 83 is closed by the wing-pair portion 86. The wing-pair portion 86 is constituted by, for example, a single valley-folded plastic film. The tubular portion 83 protrudes from the back surface of the wing-pair portion 86. The wing-pair portion 86 and the tubular portion 83 are injection-molded integrally with each other.

Thus, substantially the entire surface of the diaphragm 81 in the seventh embodiment includes the longitudinal split tubular surfaces (the longitudinal split tubular surfaces 85) and the valley 16. Accordingly, the diaphragm 81 is capable of reproducing and picking up sounds with its entire surface.

Also, no through hole is formed in the wing-pair portion 86 of the diaphragm 81 in elevational view, resulting in improved design. Moreover, the upper end of the tubular portion 83 is closed by the wing-pair portion 86, thereby preventing attachment of dust or the like in the voice coil 20.

Figure 20:
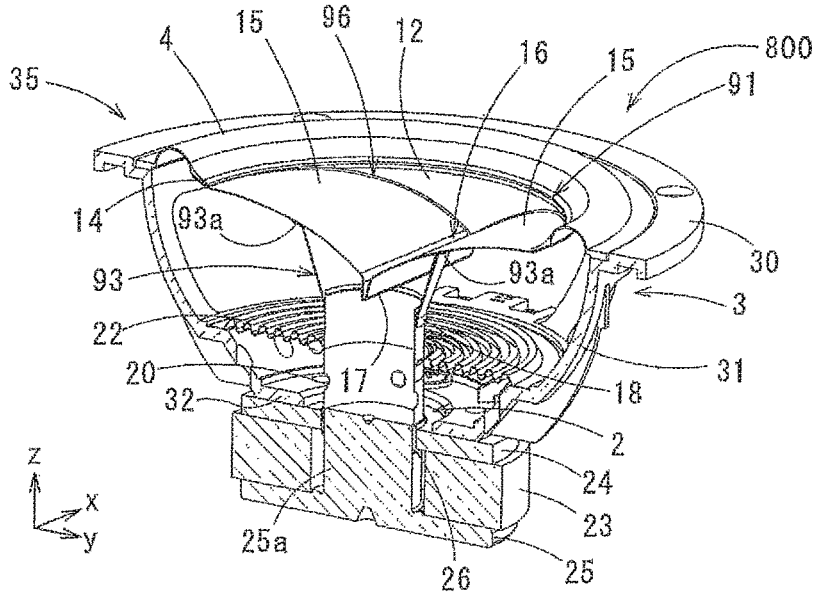
FIG. 20 illustrates a half cross-sectional perspective view of a speaker according to an eighth embodiment of the present invention.

In the diaphragm 81 in the seventh embodiment, the wing-pair portion 86 and the tubular portion 83 are injection-molded integrally with each other. In a speaker (an electroacoustic transducer) 800 according to the eighth embodiment illustrated in FIG. 20, in contrast, a wing-pair portion 96 and a tubular portion 93 of a diaphragm 91 are molded separately and bonded to each other with adhesive, for example. That is, the wing-pair portion 96 and the tubular portion 93 may be formed integrally with each other as follows: the wing-pair portion 96 is constituted by, for example, a single valley-folded plastic film without forming the through hole as in the seventh embodiment; the tubular portion 93 having a bonding portion 93*a* at its upper end portion is formed independently of the wing-pair portion 96; and the bonding portion 93*a* of the upper end portion of the tubular portion 93 is bonded to a lower surface of the wing-pair portion 96 (the longitudinal split tubular surfaces 15 and a lower surface of the coupled portion 17). In this construction, the wing-pair portion 96 and the tubular portion 93 may be formed of different materials.

Figure 21:
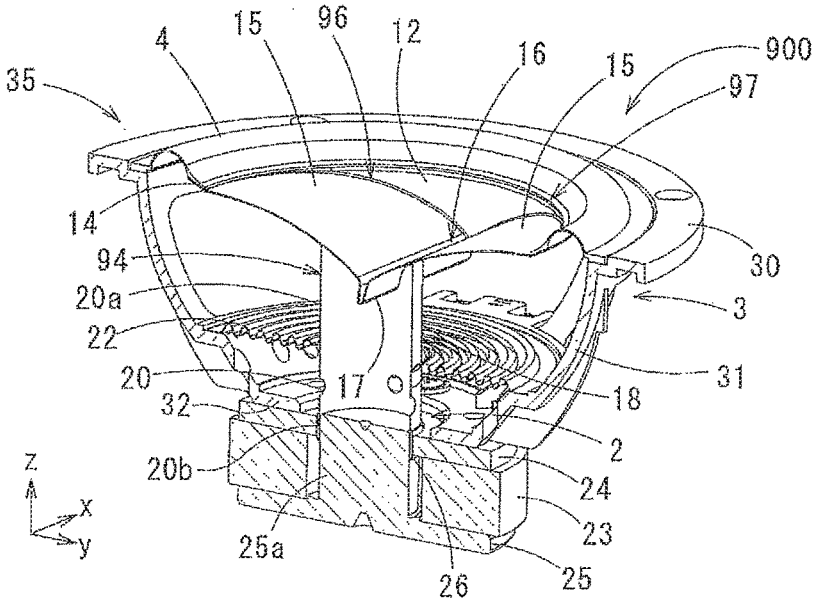
FIG. 21 illustrates a half cross-sectional perspective view of a speaker according to a ninth embodiment of the present invention.

In a speaker (an electroacoustic transducer) 900 according to the ninth embodiment illustrated in FIG. 21, the bobbin 20*a* having the cylindrical shape is extended to a back surface of the wing-pair portion 96 of a diaphragm 97. The extended portion forms a tubular portion 94 that couples the wing-pair portion 96 and the voice coil 20 to each other. An upper end portion of the tubular portion 94, e.g., an upper end portion of the bobbin 20*a* and the back surface of the wing-pair portion 96 may be bonded to each other with adhesive, for example.

It is to be understood that the present invention is not limited to the illustrated embodiments, but may be embodied with various changes and modifications without departing from the spirit and scope of the invention.

For example, the diaphragm has the circular shape in elevational view in each of the above-described embodiments, but the diaphragm may be constructed such that each of the longitudinal split tubular surfaces of the wing-pair portion is constituted by a surface of a curved membrane of a quadrilateral shape such as a rectangular shape, and the curved membranes are arranged next to each other to form the longitudinal split tubular surfaces, with the valley therebetween. Furthermore, the tubular portion may be formed in the valley as in each embodiment and joined to the upper end portion of the voice coil. In this construction, a plurality of the tubular portions may be formed so as to be spaced apart from each other in the longitudinal direction of the valley, and each of the tubular portions may be joined to the voice coil.

While the present invention is applied to the speaker in the above-described embodiments, the present invention may be applied to microphones. In the case where the present invention is applied to the speaker, a converter such as a voice coil motor converts an electric signal based on a voice signal into vibration of the diaphragm. Also in the case where the present invention is applied to the microphones, the voice coil motor may be used as the converter, for example, and this converter converts, into electric signals, vibration of the diaphragm vibrated by sound waves. In the microphone to which the present invention is applied, the longitudinal split tubular surfaces serve as vibration surfaces, and the diaphragm and the converter are firmly connected to each other. This construction reliably transmits vibration, thereby providing good directivity with reliable sensitivity, whereby the microphone can pick up sounds with a wide directivity over a wide frequency range from low frequencies to high frequencies.

REFERENCE NUMERALS

1: Diaphragm, 2: Actuator (Converter), 3: Support Frame, 4: Edge Member, 11: Wing-pair Portion, 12: End Plate, 13: Tubular Portion, 14: Ring Plate, 15: Longitudinal Split Tubular Surface, 16: Valley, 17: Coupled Portion, 18: Straight Tubular Portion, 19: Through Hole, 20: Voice Coil, 20*a*: Bobbin, 20*b*: Coil, 21: Magnet Mechanism, 22: Damper, 23: Magnet, 24: Outer Yoke, 25: Inner Yoke, 25*a*: Pole, 26: Magnetic Gap, 30: Flange Portion, 31: Arm Portion, 32: Annular Frame Portion, 35: Supporter, 51: Bar, 55: Diaphragm, 56: Wing-pair Portion, 57: Closing Plate (Cap Member), 58: Longitudinal Split Tubular Surface, 61: Diaphragm, 62: Center Cap (Cap Member), 65: Diaphragm, 66: Center Cap (Cap Member), 67: Longitudinal Split Tubular Surface, 68: Second Valley, 71: Diaphragm, 72: Center Cap (Cap Member), 73: Top Portion, 74: Longitudinal Split Tubular Surface, 81: Diaphragm, 83: Tubular Portion, 85: Longitudinal Split Tubular Surface, 86: Wing-pair Portion, 93: Tubular Portion, 93*a*: Bonding Portion, 94: Tubular Portion, 96: Wing-pair Portion

The invention claimed is:

1. An electroacoustic transducer, comprising:

a diaphragm comprising a wing-pair portion in which a pair of longitudinal split tubular surfaces are arranged next to each other, and a valley is formed between respective side portions of the pair of longitudinal split tubular surfaces and an end plate that closes opposite ends of the valley;

a converter comprising a magnet mechanism and a voice coil configured to perform conversion between vibration of the diaphragm along a depth direction of the valley and an electric signal corresponding to the vibration; and a supporter that supports the diaphragm such that the diaphragm is vibratable along the depth direction of the valley, wherein a tubular portion is provided at an intermediate portion of the valley to couple the diaphragm and the voice coil to each other, and the tubular portion extends in the depth direction of the valley, and the wing-pair portion and the end plate are fixed to one another such that the wing-pair portion and the end plate move together when activated by the voice coil.

2. The electroacoustic transducer according to claim 1, wherein the diaphragm comprises a through hole formed at a position at which the tubular portion is provided, and the diaphragm is provided with a cap member that closes the through hole.

3. The electroacoustic transducer according to claim 2, wherein the cap member comprises a pair of longitudinal split tubular surfaces and a valley respectively connected to the pair of longitudinal split tubular surfaces and the valley of the diaphragm.

4. The electroacoustic transducer according to claim 1, wherein the tubular portion is provided on a deep-side surface of the diaphragm in the depth direction of the valley, without a through hole formed through the diaphragm at a position at which the tubular portion is provided.

5. The electroacoustic transducer according to claim 1, wherein the tubular portion is coupled to the diaphragm such that a direction in which an axis of the tubular portion extends substantially coincides with a direction in which the diaphragm is vibrated.

6. The electroacoustic transducer according to claim 1, wherein the valley extends in an extending direction intersecting the depth direction of the valley, and wherein the tubular portion is coupled to the diaphragm at a position between a central position of the valley in the extending direction and an end portion of the diaphragm.

7. The electroacoustic transducer according to claim 1, wherein the tubular portion has a circular shape and the voice coil has a cylindrical shape, and wherein the tubular portion is coupled to the voice coil in a state in which an axis of the tubular portion coincides with an axis of the voice coil.

8. The electroacoustic transducer according to claim 1, wherein a through hole is formed on the wing-pair portion, and wherein the tubular portion is coupled to a portion of the wing-pair portion at which the through hole is formed.

* * * * *